US006056115A

United States Patent [19]

Olsen

[11] Patent Number: 6,056,115

[45] Date of Patent: May 2, 2000

[54] MULTI-BODY DIAMETER CARRIER

[75] Inventor: Robert Olsen, Medinah, Ill.

[73] Assignee: Illinois Tool Works Inc., Glenview, Ill.

[21] Appl. No.: 09/268,478

[22] Filed: Mar. 16, 1999

[51] Int. Cl.[7] ..... B65D 71/00

[52] U.S. Cl. ..... 206/150; 206/161; 53/48.3

[58] Field of Search ..... 206/147, 149, 206/150, 151, 158, 161, 162, 192, 197, 427; 53/48.1–48.9

[56] References Cited

U.S. PATENT DOCUMENTS

| | | | |
|---|---|---|---|
| 3,269,530 | 8/1966 | Wanderer | 206/150 |
| 4,149,631 | 4/1979 | Cunningham | 206/150 |
| 4,592,466 | 6/1986 | Walters et al. | 206/150 |
| 4,740,415 | 4/1988 | Hirschberger | 428/212 |
| 5,174,441 | 12/1992 | Marco | 206/150 |
| 5,437,364 | 8/1995 | Broskow . | |
| 5,456,350 | 10/1995 | Olsen et al. . | |
| 5,511,656 | 4/1996 | Olsen | 206/150 |

*Primary Examiner*—Paul T. Sewell
*Assistant Examiner*—Nhan T. Lam
*Attorney, Agent, or Firm*—Pauley Petersen Kinne & Fejer

[57] ABSTRACT

This invention relates to a carrier for unitizing a plurality of containers wherein a sheet of resilient polymeric material is formed with a plurality of container receiving apertures aligned in opposing transverse pairs so that each container receiving aperture has a small radius defining an apex at an interior edge of the container receiving aperture. A transverse web is formed between each opposing transverse pair of container receiving apertures and an elongated aperture is positioned in the transverse web between each apex of the opposing transverse pairs of container receiving apertures. The elongated apertures are preferably sized to permit a small amount of stretch in the transverse web depending upon the diameter and/or contour of the containers resulting in controlled transverse spacing between containers regardless of diameter.

8 Claims, 1 Drawing Sheet

MULTI-BODY DIAMETER CARRIER

BACKGROUND OF THE INVENTION

1. Field of the Invention

This invention relates to a carrier for unitizing a plurality of uniform containers having multiple possible container diameters.

2. Description of Prior Art

Carriers according to this invention connect two or more containers into a sturdy unitized package of containers. Carriers are generally planar arrays of rings, sometimes referred to as "six-pack carriers," typically formed from a thermoplastic sheet material. Carriers are applied to containers of various sizes and shapes. One important consideration in the design of a carrier is the adaptability of the carrier to such sizes and shapes. A cost-effective carrier is capable of application to a wide range of container sizes and configurations.

Many containers on the market have distinguishing characteristics to assist in marketing and brand identity. For instance, cans have various configurations of body diameters and chime diameters. When a can has an unusual ratio between the body diameter and the chime diameter, conventional carriers may not properly unitize a plurality of such cans without significant modification.

SUMMARY OF THE INVENTION

It is one object of this invention to provide a carrier for unitizing and maintaining proper spacing among a plurality of containers having a range of possible body diameters, chime diameters and body contours.

It is another object of this invention to provide a carrier for unitizing a plurality of containers using a carrier having a plurality of elongated apertures positioned between each transverse pair of container receiving apertures.

It is still another object of this invention to provide a carrier for unitizing a plurality of containers that does not require multiple carrier stamping dies to manufacture a variety of carriers for multiple container configurations.

It is another object of this invention to provide a carrier for unitizing a plurality of containers that does not require major modifications between carriers for containers having different diameters.

A carrier for unitizing and carrying a plurality of containers according to one preferred embodiment of this invention is used in connection with cans. The carrier according to this invention is particularly suited for application to cans having a variety of chime diameters, body diameters and/or contours.

The carrier according to this invention is preferably formed from a sheet of flexible, resilient material, such as plastic. The sheet is formed with a plurality of container receiving apertures, preferably of a generally triangular shape. The container receiving apertures are sized to stretchingly engage with a plurality of containers to form a unitized package.

The container receiving apertures are preferably aligned in the sheet in opposing transverse pairs. Each of the container receiving apertures in the opposing transverse pair has a small radius defining an apex at an interior edge of the container receiving aperture.

A transverse web is positioned between each opposing transverse pair of container receiving apertures. The transverse web provides a transverse connection between each transversely adjacent container in the package.

A plurality of elongated apertures are positioned in the sheet so that each elongated aperture is positioned in the transverse web between each apex of the opposing transverse pairs of container receiving apertures. A bridge is thus formed in the transverse web between each apex of the container receiving aperture and each extremity of the elongated aperture.

In a method for packaging a plurality of containers according to this invention, an appropriate length and/or width of the elongated apertures is pre-determined based upon the contour and/or diameter(s) of each container in the package. When the carrier is engaged with a plurality of containers, the elongated apertures permit the transverse webs in the carrier to stretch slightly depending upon the container contour and/or diameter.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
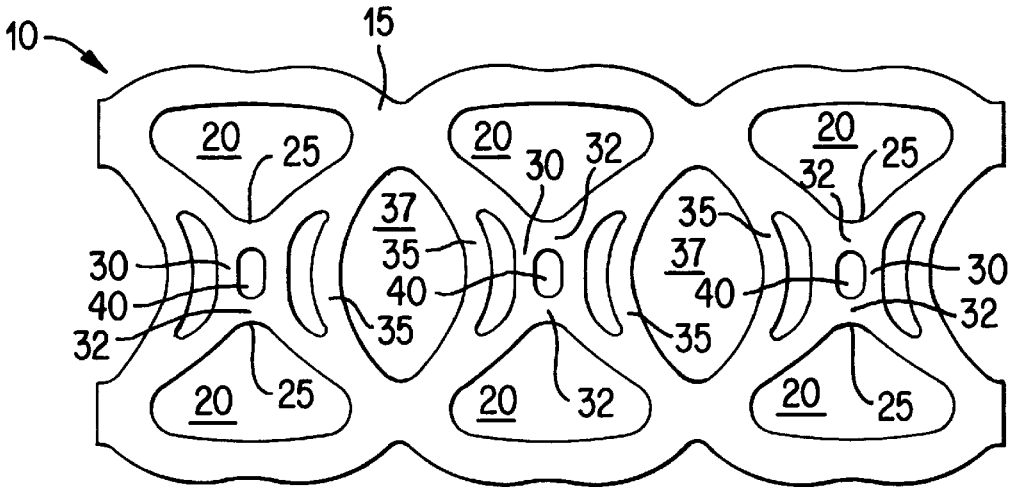
FIG. 1 is a top view of a carrier according to one preferred embodiment of this invention.
Figure 2:
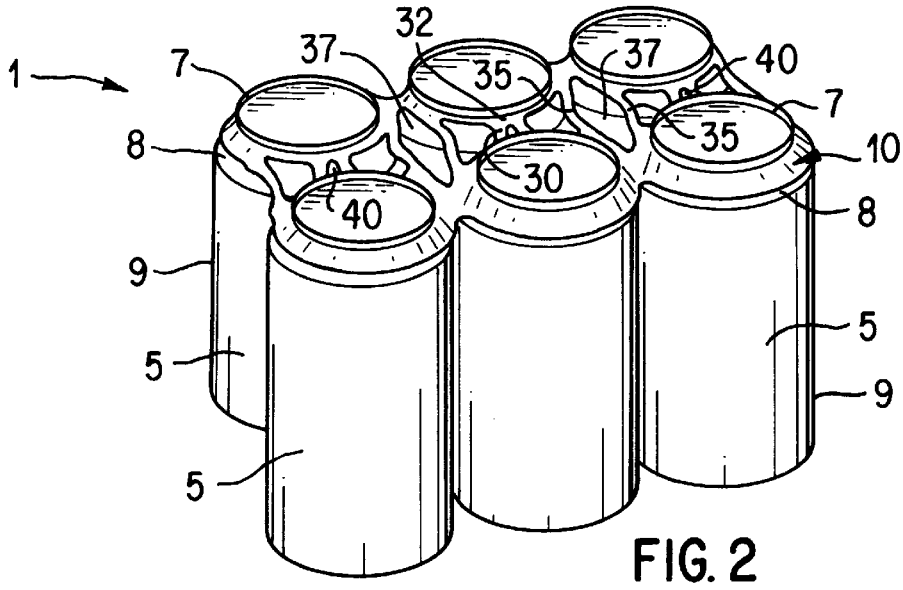
FIG. 2 is a perspective view of a package of containers according to one preferred embodiment of this invention.
Figure 3:
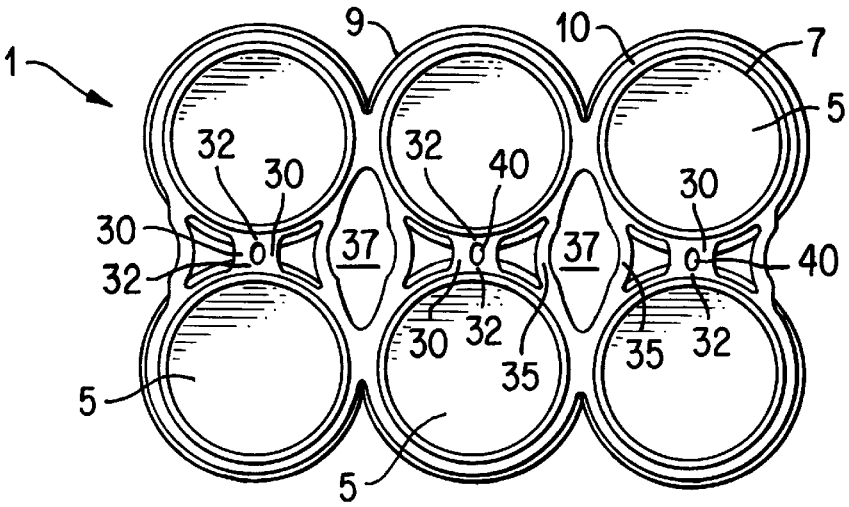
FIG. 3 is a top view of the package shown in FIG. 2.

FIG. 1 shows carrier 10 for carrying a plurality of containers 5. "Containers" as used in the Specification and Claims may include cans, bottles, jars and other packages known to those having ordinary skill in the art, however, cans, such as shown in FIGS. 2 and 3, are especially suited for use in connection with carrier 10 according to this invention. Cans typically comprise chime 7, a generally vertical body 9 and a sloped transition portion 8 between chime 7 and the generally vertical body 9. Containers 5 are preferably like-sized within a single carrier 10.

Carrier 10 unitizes a plurality of containers 5 to create package 1, such as package 1 shown in FIGS. 2 and 3. Sheet 15 is preferably constructed from a flexible, resilient material such as plastic. In one preferred embodiment of this invention, sheet 15 is made from low- to medium-density polyethylene.

Sheet 15 of material is preferably cut, using means known to those skilled in the art, such as a stamping die, to form a plurality of container receiving apertures 20 in sheet 15. Container receiving apertures 20 are preferably sized to stretchingly engage with containers 5 to form package 1. In one preferred embodiment of this invention, shown in FIGS. 1–3, container receiving apertures 20 are formed in two longitudinal rows and three lateral ranks resulting in six container receiving apertures 20. Container receiving apertures 20 may be arranged in any other feasible arrangement of longitudinal rows and lateral ranks preferred by consumers and merchandisers.

Container receiving apertures 20 are preferably aligned in opposing transverse pairs. Each container receiving aperture 20 in the opposing transverse pair has a small radius defining apex 25 at an interior edge of container receiving aperture 20. As a result, each container receiving aperture 20 is preferably configured in a generally triangular shape as shown in FIG. 1.

Transverse web 30 is preferably positioned between each opposing transverse pair of container receiving apertures 20. Transverse web 30 provides a transverse connection and stabilization between each transversely adjacent container 5 in package 1.

According to a preferred embodiment of this invention, a plurality of elongated apertures 40 are positioned in sheet 15. Each elongated aperture 40 is positioned in transverse web 30 between each apex 25 of the opposing transverse pairs of container receiving apertures 20. Bridge 32 is formed in transverse web 30 between each extremity of elongated aperture 40 and apex 25 of each container receiving aperture 20.

As shown in FIGS. 1–3, elongated aperture 40 is preferably elongated in the transverse direction. In one preferred embodiment of this invention, a radius of each elongated aperture 40 is approximately equal to the small radius of apex 25 of container receiving aperture 40. In another preferred embodiment of this invention, elongated aperture 40 may comprise a circular aperture.

In addition to providing desired stretching characteristics of transverse web 30 in carrier 10, elongated apertures 40 also reduce the weight and required material in each carrier 10. Such weight and material reduction is especially beneficial when, as here, the performance of carrier 10 is enhanced.

As shown in FIGS. 1–3, carrier 10 preferably further comprises a plurality of finger straps 35 and access apertures 37 for convenient portability of package 1. As shown in FIG. 1, access apertures 37 are preferably formed in sheet 15 between transverse pairs of container receiving apertures 20 and between longitudinally adjacent pairs of container receiving apertures 20. Finger straps 35 are preferably formed on opposite longitudinal sides of access apertures 37.

In a method for packaging a plurality of containers 5 using carrier 10 as described above, an appropriate length and/or width of elongated aperture 40 is pre-determined based upon one or more factors. A critical factor for determining the appropriate length of elongated aperture 40 is a diameter of chime 7 and a diameter of body 9 of each container 5 in package 1. As the diameter of body 9 increases and the diameter of chime 7 remains constant, transverse web 30 must stretch a greater amount. Transverse web 30 stretches a greater amount as a transverse width of bridge 32 in transverse web 30 is reduced. Therefore, an increase in a transverse length of elongated aperture 40 permits greater stretching in transverse web 30.

As the transverse width of bridge 32 is reduced, apex 25 stretches a greater amount around a perimeter of chime 7. This stretching results in a smoother interface between chime 7 and container receiving aperture 20. Such a smoother interface results in a better aesthetic appearance of package 1.

In one preferred embodiment of this invention, the length and/or width of elongated aperture 40 may be adjusted by using an appropriate insert in a stamping die. As the length of elongated aperture 40 is increased, the transverse width of bridge 32 decreases a corresponding amount. Carrier 10 may then be stamped into the proper configuration using the stamping die having the appropriate insert.

After forming elongated aperture 40 having the appropriate length within sheet 15, carrier 10 is engaged with a plurality of containers 5. Each container receiving opening 20 is preferably engaged with each container 5 so that transverse web 30 is permitted to stretch slightly because of elongated aperture 40.

Without the inclusion of an appropriately sized elongated aperture 40, transverse web 30 may buckle or bunch up between transversely adjacent containers 5. Elongated aperture 40 promotes appropriate stretching of transverse web 30 between transversely adjacent containers 5, thus resulting in a smooth transverse web 30 and a more aesthetically pleasing carrier 10 and package 1.

In addition, elongated aperture 40 results in proper spacing between containers 5 in a transverse direction. If transverse web 30 is too tight between transversely adjacent containers 5, bottoms of containers 5 may splay outward, thus resulting in a defective package 1. Elongated apertures 40 permit a slight stretch in transverse web 30 that avoids package 1 having splayed containers 5. As elongated aperture 40 approaches a circular configuration, transverse spacing between adjacent containers 5 will be maintained for containers 5 having larger body 9 diameters.

While in the foregoing specification this invention has been described in relation to certain preferred embodiments thereof, and many details have been set forth for purpose of illustration, it will be apparent to those skilled in the art that carrier 10 is susceptible to additional embodiments and that certain of the details described herein can be varied considerably without departing from the basic principles of the invention.

I claim:

1. A carrier for unitizing a plurality of containers, the carrier comprising:

a sheet of resilient polymeric material having a plurality of container receiving apertures aligned in opposing transverse pairs, each container receiving aperture in the opposing transverse pair having a small radius defining an apex at an interior edge of the container receiving aperture;

a transverse web positioned between each opposing transverse pair of container receiving apertures;

a plurality of elongated apertures positioned in the sheet, each elongated aperture positioned in the transverse web between each apex of opposing transverse pairs of container receiving apertures.

2. The carrier of claim 1 wherein a radius of each elongated aperture is approximately equal to the small radius of the apex.

3. The carrier of claim 1 wherein the elongated aperture is elongated in the transverse direction.

4. The carrier of claim 1 wherein the container receiving apertures are configured in a triangular shape.

5. A method for packaging a plurality of containers using a carrier formed from a sheet of resilient polymeric material, the method comprising:

forming a plurality of container receiving apertures aligned in opposing transverse pairs in the sheet, each container receiving aperture in the opposing transverse pair having a small radius defining an apex at an interior edge of the container receiving aperture and a transverse web positioned between each opposing transverse pair of container receiving apertures;

determining an appropriate length of an elongated aperture based upon a diameter of each container of the plurality of containers; and forming a plurality of the elongated apertures in the sheet, each elongated aperture positioned in the transverse web between each apex of opposing transverse pairs of container receiving apertures.

6. The method according to claim 5 further comprising:

engaging each container receiving opening of the plurality of container receiving openings to each container of the plurality of containers.

7. The method according to claim 6 further comprising:

reducing a transverse width of a bridge between the apex and an extremity of the elongated aperture to increase stretching engagement between the transverse web and each container.

8. The method according to claim 6 further comprising:

maintaining equivalent transverse spacing between containers having different body diameters based upon the length of the elongated apertures.

* * * * *